US011275329B2

(12) United States Patent
Nagata et al.

(10) Patent No.: US 11,275,329 B2
(45) Date of Patent: Mar. 15, 2022

(54) IMAGE FORMING APPARATUS

(71) Applicant: Ricoh Company, Ltd., Tokyo (JP)

(72) Inventors: Atsushi Nagata, Kanagawa (JP); Masakazu Imai, Kanagawa (JP); Takeshi Fukao, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/237,190

(22) Filed: Apr. 22, 2021

(65) Prior Publication Data

US 2021/0333728 A1 Oct. 28, 2021

(30) Foreign Application Priority Data

Apr. 28, 2020 (JP) ..... JP2020-078852

(51) Int. Cl.
*G03G 15/16* (2006.01)
*G03G 15/01* (2006.01)
*G03G 15/00* (2006.01)

(52) U.S. Cl.
CPC ..... *G03G 15/167* (2013.01); *G03G 15/0136* (2013.01); *G03G 15/0189* (2013.01); *G03G 15/1605* (2013.01); *G03G 15/5012* (2013.01); *G03G 15/5029* (2013.01); *G03G 2215/00721* (2013.01)

(58) Field of Classification Search
CPC ..... G03G 15/0136; G03G 15/0189; G03G 15/1605; G03G 15/167; G03G 15/5012; G03G 15/5029; G03G 2215/00721
See application file for complete search history.

(56) References Cited

U.S. PATENT DOCUMENTS

2012/0275828 A1* 11/2012 Yamaki ..... G03G 15/1615 399/313
2014/0270819 A1 9/2014 Wada et al.
2015/0037054 A1 2/2015 Nagata et al.
(Continued)

FOREIGN PATENT DOCUMENTS

JP 2014-071330 4/2014
JP 2014178660 A * 9/2014 ..... G03G 15/1605
(Continued)

*Primary Examiner* — Joseph S Wong
(74) *Attorney, Agent, or Firm* — Xsensus LLP

(57) ABSTRACT

An image forming apparatus includes a latent image bearer, a toner image forming unit, an intermediate transfer member, a primary transfer member, a secondary transfer member, a switching unit, and control circuitry. The toner image forming unit forms toner images on the latent image bearer. The primary transfer member transfers the toner images on the latent image bearer onto the intermediate transfer member. The secondary transfer member transfers the toner images on the intermediate transfer member onto recording materials. The switching unit switches a position of one of the secondary transfer member and the intermediate transfer member between a first and a second position. The control circuitry controls at least one of a first and a second operation. The control circuitry changes at least one of the first and the second operation when the toner images satisfy a specified abnormal image reduction condition at a first and a second timing.

12 Claims, 8 Drawing Sheets

(56) References Cited

U.S. PATENT DOCUMENTS

| | | | |
|---|---|---|---|
| 2015/0346651 | A1 | 12/2015 | Nagata et al. |
| 2016/0139543 | A1 | 5/2016 | Imai et al. |
| 2016/0154345 | A1 | 6/2016 | Nagata |
| 2017/0108804 | A1 | 4/2017 | Nagata |
| 2017/0299994 | A1 | 10/2017 | Nagata et al. |
| 2018/0164720 | A1 | 6/2018 | Nagata et al. |

FOREIGN PATENT DOCUMENTS

| | | | | |
|---|---|---|---|---|
| JP | 2014-224941 | | 12/2014 | |
| JP | 2015-166759 | | 9/2015 | |
| JP | 2015225178 A | * | 12/2015 | ..... G03G 15/1665 |
| JP | 2017-207653 | | 11/2017 | |

* cited by examiner

IMAGE FORMING APPARATUS

CROSS-REFERENCE TO RELATED APPLICATION

This patent application is based on and claims priority pursuant to 35 U.S.C. § 119(a) to Japanese Unexamined Patent Application Publication No. 2020-078852, filed on Apr. 28, 2020, in the Japan Patent Office, the entire disclosure of which is incorporated by reference herein.

BACKGROUND

Technical Field

Aspects of the present disclosure relate to an image forming apparatus.

Related Art

There is known an image forming apparatus that controls the contact operation so as to slow down the moving speed of a secondary transfer member when the secondary transfer member, which is separated from the intermediate transfer member, is moved toward the intermediate transfer member when an image density of the leading end side image portion formed on the leading end side of the recording material is low.

SUMMARY

In an aspect of the present disclosure, there is provided an image forming apparatus that includes a latent image bearer, a toner image forming unit, an intermediate transfer member, a primary transfer member, a secondary transfer member, a switching unit, and control circuitry. The toner image forming unit forms a toner image on the latent image bearer. The primary transfer member primarily transfers the toner image borne on the latent image bearer onto the intermediate transfer member. The secondary transfer member sandwiches a recording material conveyed, at a secondary transfer portion between the secondary transfer member and the intermediate transfer member, and secondarily transfers the toner image borne on the intermediate transfer member onto the recording material. The switching unit switches a position of one of the secondary transfer member and the intermediate transfer member between a first position at which the secondary transfer member and the intermediate transfer member sandwiches the recording material and a second position at which a distance between the intermediate transfer member and the secondary transfer member is farther than at the first position. The control circuitry controls at least one of a first operation in which the second position is switched to the first position and a second operation in which the first position is switched to the second position. The control circuitry changes at least one of the first operation and the second operation when a toner image portion formed in an opposing area on the latent image bearer opposing the intermediate transfer member satisfies a specified abnormal image reduction condition at a first timing at which a leading end of the recording material enters the secondary transfer portion and a second timing at which a trailing end of the recording material exits the secondary transfer portion.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
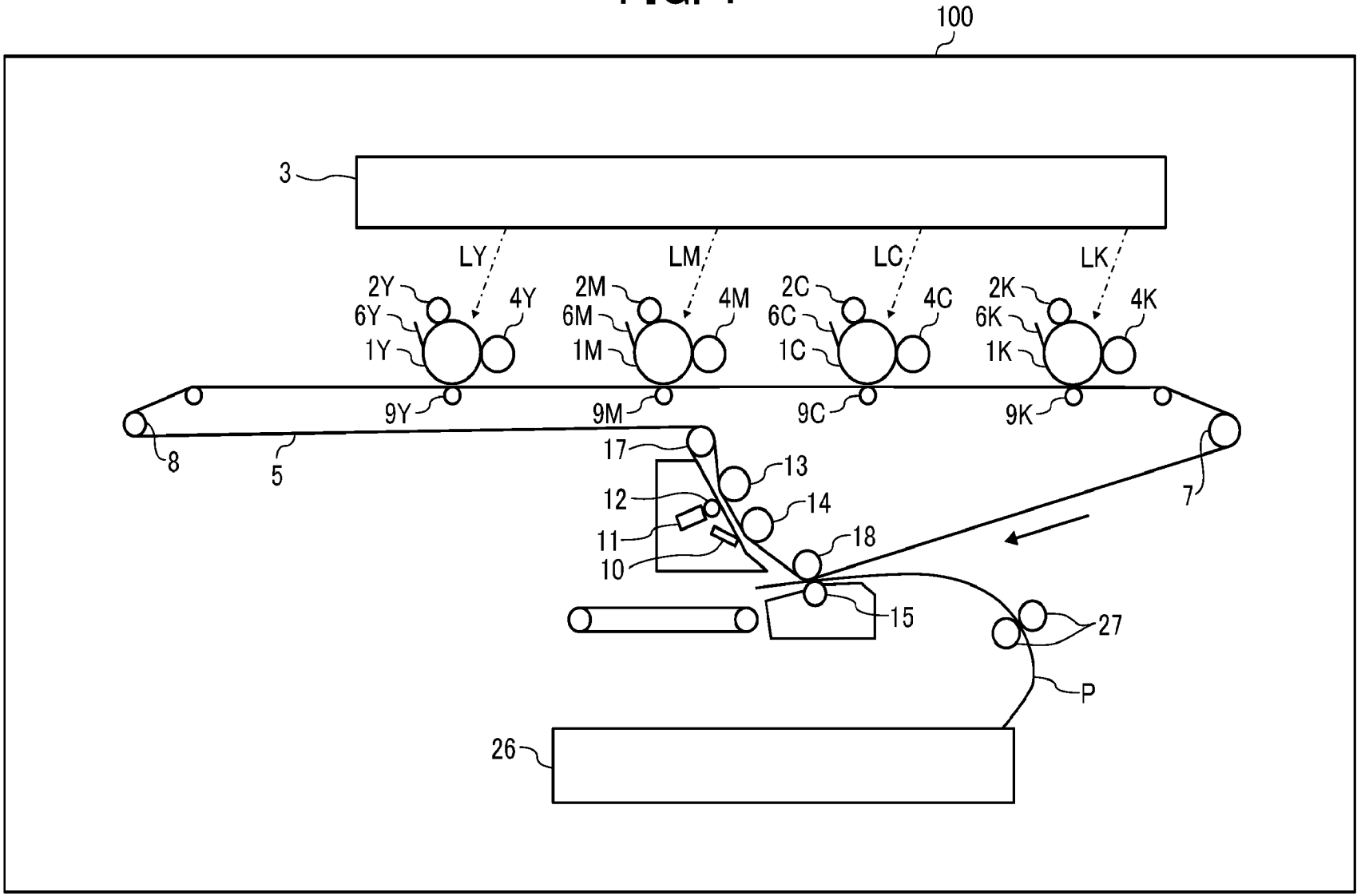
FIG. 1 is a schematic diagram illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

FIG. 1 is a schematic diagram illustrating a configuration of an image forming apparatus 100 according to an embodiment of the present disclosure. The image forming apparatus 100 according to the present embodiment is a tandem-type color image forming apparatus provided with an intermediate transfer belt as an intermediate transfer member, four drum-shaped photoconductors 1Y, 1M, 1C, and 1K, as latent image bearers, are arranged at equal intervals along the surface traveling direction of the intermediate transfer belt in the image forming apparatus main body. The suffixes Y, M, C, and K of the reference numerals in FIG. 1 indicate the colors of yellow, magenta, cyan, and black, respectively. These suffixes may be omitted below.

A toner image forming unit, for example, a photoconductor cleaning blade 6, a charger 2, an optical writing device 3 (serving as an exposure device), and a developing device 4 (serving as a developing unit), is disposed around the photoconductor 1. The developing unit includes four developing devices 4 (yellow, magenta, cyan, and black). In the full-color image formation, a visible image is formed in the order of yellow developing device 4Y, magenta developing device 4M, cyan developing device 4C, and black developing device 4K. The visible images of each color are primarily transferred to the intermediate transfer belt 5 so as to form full-color images.

The intermediate transfer belt 5 is extended by a driving roller 7, a tension roller 8, and so forth. The intermediate transfer belt 5 is driven by a driving motor. The process speed is adjusted to 415 mm/sec. Primary transfer rollers 9 as primary transfer members and belt-cleaning counter rollers 13 and 14 are disposed inside the circumference of the intermediate transfer belt 5. Each roller is supported by the side plates of the intermediate transfer belt unit from both sides of the intermediate transfer belt 5 via bearings and arms.

The primary transfer roller 9 (serving as the primary transfer member) is disposed at a contact portion (in the primary transfer unit) of the photoconductor 1 and the intermediate transfer belt 5, and a specified transfer bias is applied to the primary transfer roller 9.

The intermediate transfer belt 5 has a single layer or multiple layers of, e.g., polyvinylidene difluoride (PVDF), ethylene tetrafluoro ethylene (ETFE), polyimide (PI), or polycarbonate (PC) and having a conductive material such as carbon black dispersed. The volume resistivity is adjusted to be $10^8$ to $10^{12}$ Ω·cm, and the surface resistivity of the surface resistivity is $10^9$ to $10^{13}$Ω/□.

Optionally, the surface of the intermediate transfer belt 5 may be coated with a release layer. The material for the coat may be, ethylene tetrafluoro ethylene (ETFE), polytetrafluoroethylene (PTFE), polyvinylidene difluoride (PVDF), or phenylethylamine (PEA). Alternatively, the material for the coat can be, but not be limited to, a fluoroplastic such as tetrafluoroethylene-hexafluoropropylene copolymer (FEP) or polyvinyl fluoride (PVF).

The cleaning blade 10 made of urethane rubber is pressed against the intermediate transfer belt 5 so as to dam and clean the toner. To facilitate cleaning, a solid lubricant 11 is applied by a brush 12 as a lubricant coater. The belt is pressured by a tension roller 17 in order to restrain the vibration to the intermediate transfer belt 5 by the brush 12. In the present embodiment, although the tension roller 17 is provided outside the intermediate transfer belt 5, the same effect can be obtained even inside of the intermediate transfer belt 5.

Among the primary transfer rollers 9K, 9C, 9M, and 9Y, the primary transfer rollers 9C, 9M, and 9Y for colors can be separated from the intermediate transfer belt 5 by the same contact-separation mechanism as in the comparative technology. The primary transfer rollers 9C, 9M, and 9Y for colors contact with the photoconductors 1C, 1M, and 1Y, respectively, in the full-color mode. And, the primary transfer rollers 9C, 9M, and 9Y for color-image separate from the photoconductors 1C, 1M, and 1Y in the monochrome mode, and the intermediate transfer belt 5 is separated from the photoconductors 1C, 1M, and 1Y. On the other hand, the primary transfer roller 9K for monochrome always contacts the black photoconductor 1K via the intermediate transfer belt 5, as illustrated in FIG. 1.

Further, the image forming apparatus 100 according to the present embodiment includes a feeding unit 26 in which the sheet P as a recording material is stored, and a registration roller pair 27 in the downstream side of the sheet feeding direction of the feeding unit 26.

Figure 2:
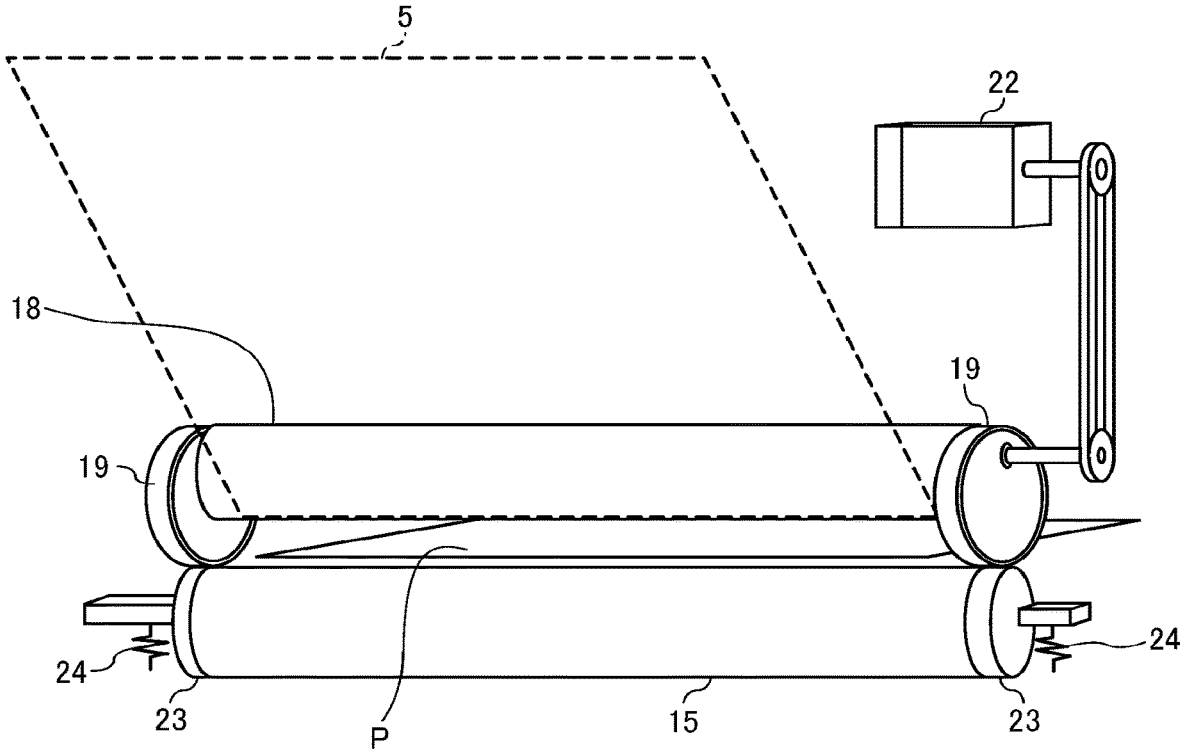
FIG. 2 is a schematic diagram illustrating a contact-separation mechanism in which the position of a secondary transfer roller is switched between a nipping position where a sheet is sandwiched between the secondary transfer roller and an intermediate transfer belt and a separating position where the secondary transfer roller is farther from the intermediate transfer belt than the nipping position, in the image forming apparatus of FIG. 1.

FIG. 2 is a schematic diagram illustrating a contact-separation mechanism in which a switching unit switches the position of the secondary transfer roller 15 between a first position where the sheet P is sandwiched between the secondary transfer roller 15 and the intermediate transfer belt 5 wound around a counter roller 18 and a second position where the secondary transfer roller 15 is farther from the intermediate transfer belt 5 than the nipping position. The first position and the second position may be referred to as a nipping position and a separating position, respectively, in the following description. Although the contact-separation mechanism according to the present embodiment uses a stepping motor and eccentric cams 19, other configurations may be used for the contact-separation mechanism.

The secondary transfer roller 15 that serves as a secondary transfer member and the counter roller 18 are arranged as illustrated in FIG. 2 so as to sandwich the intermediate transfer belt 5. A biasing member 24 applies a biasing force to the secondary transfer roller 15 such that the secondary transfer roller moves toward the counter roller 18. The biasing member 24 may be, for example, a compression spring, or a tension spring. The biasing member 24 applies a specified the secondary transfer nip pressure (transfer pressure) to the sheet P and the intermediate transfer belt 5.

A pair of eccentric cams 19 are disposed coaxially with the counter roller 18 on the axial ends of the counter roller 18. The eccentric cams 19 contact a pair of ball bearings 23 that are attached to both ends of the secondary transfer roller 15 so as not to interfere with the rotation of the secondary transfer roller 15. The eccentric cams 19 and a shaft are attached each other with a D-shaped groove, when the shaft on which the eccentric cams 19 are attached rotates, the eccentric cams 19 rotate at same timing and same angle.

The shape of the eccentric cams 19 is formed so that the shortest distance between the axis of the eccentric cams 19 and the external portion of the eccentric cams 19 is shorter than the diameter of the counter roller 18, and the longest distance between the axis of the eccentric cams 19 and the external portion of the eccentric cams 19 is longer than the diameter of the counter roller 18.

The shaft on which the eccentric cams 19 are attached is configured so as to be freely controlled the rotation by the stepping motor 22. In FIG. 2, the rotation of the stepping motor 22 is transmitted to the shaft attached to the eccentric cams 19 via a gear and a timing belt. The stepping motor 22 can be controlled the rotation at a step angle of 1.8 degree.

As described above, the eccentric cams 19 contact the ball bearings 23. Due to such a configuration, the secondary transfer roller 15 fixed by the biasing member 24 is pushed down in a direction away from the counter roller 18 when the eccentric cams 19 rotate and a first inequality given below is satisfied.

First Inequality

Distance from Axis of Rotation of Eccentric Cam 19 to Contact Portion of Ball Bearing 23 of Eccentric Cam 19+Radius of Ball Bearing 23>Radius of Counter Roller 18+Radius of Secondary Transfer Roller 15

Then, the rotation of the eccentric cams 19 is started by the stepping motor 22, and when a second inequality given below is satisfied, the secondary transfer roller 15 and the counter roller 18 come into contact with each other, and the specified secondary transfer nip pressure can be applied.

Second Inequality

Distance from Axis of Rotation of Eccentric cam 19 to Contact Portion of Ball Bearing 23 of Eccentric Cam 19+Radius of Ball Bearing 23<Radius of Counter Roller 18+Radius of Secondary Transfer Roller 15

Figure 3:
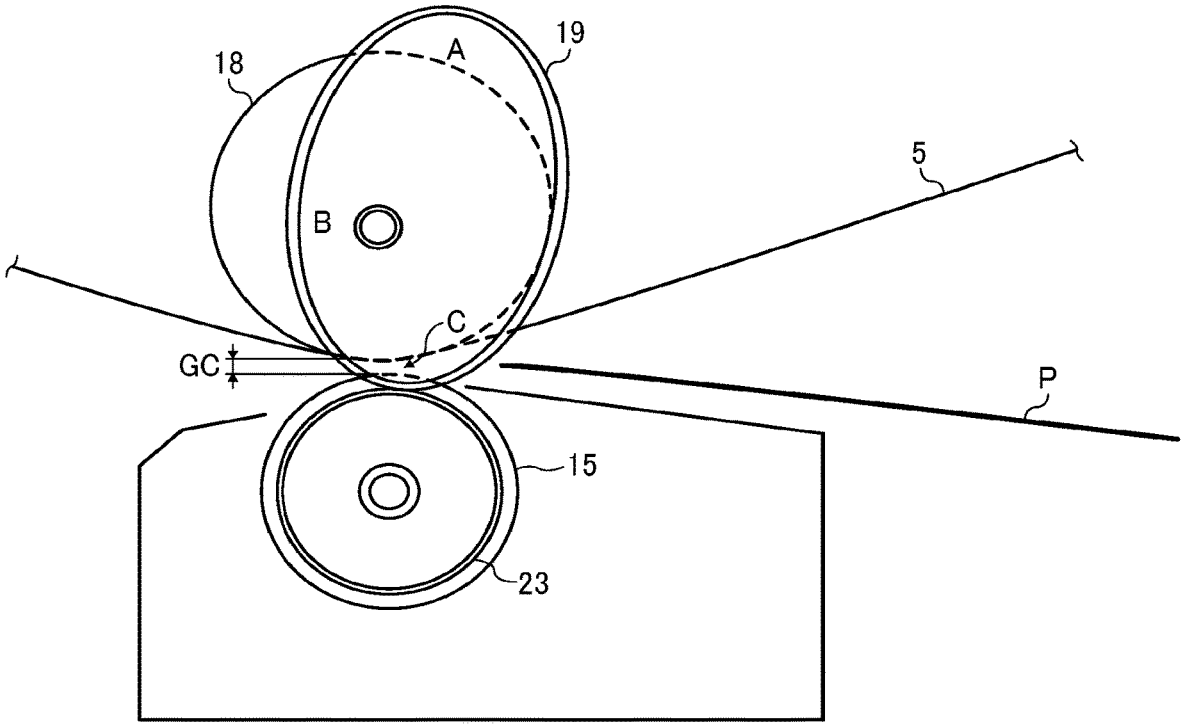
FIG. 3 is a schematic diagram illustrating a state of a cam immediately before a sheet enters a transfer nip in the image forming apparatus of FIG. 1.
Figure 4:
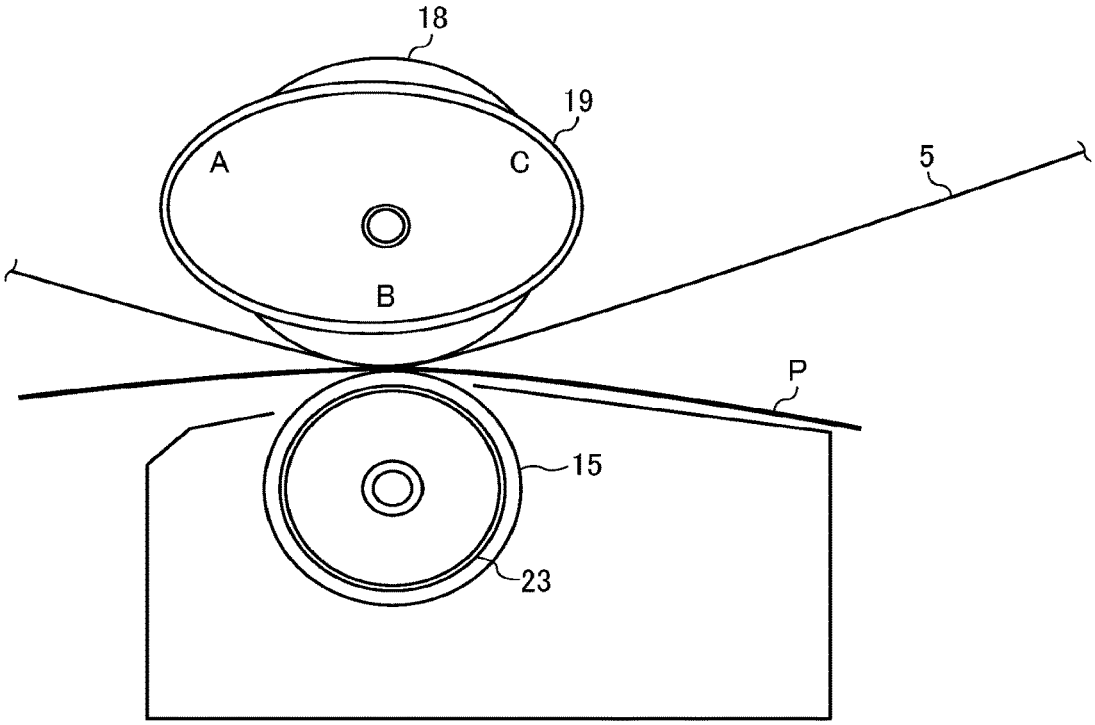
FIG. 4 is a schematic diagram illustrating a state of the cam when a toner image is secondarily transferred onto a sheet in the image forming apparatus.

FIG. 3 is a schematic view illustrating the state of the cam immediately before the sheet enters the transfer nip. FIG. 4 is a schematic view illustrating the state of the cam when the toner image is secondarily transferred onto the sheet. Each of the eccentric cams 19 is set with three stop positions indicated by reference numerals A, B, and C in FIGS. 3 and 4.

When the cam position is stationary at the position of the reference numeral A, the secondary transfer roller 15 takes first separating position, and the secondary transfer roller 15 and the counter roller 18 are separated by a gap size GA. When the cam position is stationary at the position of the reference numeral C, the secondary transfer roller 15 takes second separating position, and the secondary transfer roller 15 and the counter roller 18 are separated by a gap size GC (GC<GA) as illustrated in FIG. 3.

On the other hand, when the cam position is stationary at the reference numeral B, a third inequality given below is satisfied. Accordingly, as illustrated in FIG. 4, the secondary transfer roller 15 takes a nipping position and the secondary transfer roller 15 and the counter roller 18 are in contact with each other via the intermediate transfer belt 5 (or via the sheet P if the sheet P is present). At this time, the biasing member 24 is configured so as to obtain the secondary transfer nip pressure necessary to transfer the toner image to the sheet P.

Third Inequality

Radius from Axis of Eccentric Cam 19 to Circumference at Reference Numeral B+Radius of Ball Bearing 23)<(Radius of the Counter Roller 18+Radius of Secondary Transfer Roller 15

The eccentric cams 19 can continuously change the cam position in the order of C, B, A, and C by a driving component such as the stepping motor 22 and control.

In the present embodiment, when the sheet P enters the secondary transfer portion where the secondary transfer roller 15 and the counter roller 18 face each other via the intermediate transfer belt 5, until the leading end of the sheet P reaches the secondary transfer portion, the gap between the secondary transfer roller 15 and intermediate transfer belt 5 is secured the gap size GA or the gap size GC by the contact-separation mechanism of the secondary transfer roller 15. This gap is secured to reduce the impact when the sheet P enters the secondary transfer portion, and it is desired that the gap size be equal to or wider than the thickness of the sheet P. In other words, by keeping the secondary transfer roller 15 and the intermediate transfer belt 5 apart until the leading end of the sheet P reaches the secondary transfer portion, the impact when the leading end of the sheet P enters the secondary transfer portion is mitigated than when the leading end of the sheet P enters where the secondary transfer roller 15 is in the nipping position and in contact with the intermediate transfer belt 5. As a result, shock jitter that the toner images of each color primarily transferred from the photoconductors 1Y, 1M, 1C, and 1K to the intermediate transfer belt 5 are disturbed due to this impact is reduced, and the occurrence of the abnormal images (such as uneven horizontal streaks of image density) due to the shock jitter are reduced.

The larger the gap size between the secondary transfer roller 15 and the intermediate transfer belt 5 until the sheet P enters the secondary transfer section (the separation amount), the more effective in mitigating the impact as the sheet P rushes in, up to a certain thickness that exceeds the thickness of the sheet P. However, even if being larger, there is little change in the effect of mitigating the magnitude of the impact when the sheet P enters the sheet P. Rather, if the gap size is too large, the travel distance required for the contact-separation movement of the secondary transfer roller 15 is longer. For this reason, it is desirable to set the gap size as large as possible within a range in which the effect of mitigating the impact when the paper P rushes is enhanced.

In the present embodiment, the stepping motor 22 that drives the eccentric cams 19 of the contact-separation mechanism is controlled so that the secondary transfer roller 15, which is in the separating position, is switched to the nipping position after the leading end of the sheet P enters the secondary transfer portion and by the time the leading end of the toner image on the intermediate transfer belt 5 enters the secondary transfer portion. As a result, when the leading end of the toner image on the intermediate transfer belt 5 enters the secondary transfer portion, the movement of the secondary transfer roller 15 to the nipping position is completed, and the specified secondary transfer nip pressure is applied to the secondary transfer portion. Accordingly, the toner image on the intermediate transfer belt 5 can be sequentially transferred from the leading end thereof to the sheet P at an appropriate secondary transfer nip pressure.

However, when a margin amount on the leading end side of the sheet P is small, the leading end of the toner image enters the secondary transfer portion after the leading end of the sheet P enters the secondary transfer portion and before the nipping operation is completed. In this case, since the movement of the secondary transfer roller 15 to the nipping position is not completed, the specified secondary transfer nip pressure is not applied to the secondary transfer portion, the abnormal images such as white spots at the may occur in the image portion corresponding to the leading end side edge due to insufficient transfer pressure on the leading end side of the toner image.

On the other hand, in order to restrain the abnormal images corresponding to the leading end side portion of the toner image, the nipping operation can be controlled so that the nipping operation is completed earlier, so that the nipping operation is completed before the leading end side portion reaches the secondary transfer portion. However, in this case, at the time when the leading end of the sheet P enters the secondary transfer portion, the movement of the secondary transfer roller 15 to the nipping position may be started or the movement to the nipping position may be completed. For this reason, the gap size (separation amount) when the leading end of the sheet P enters the secondary transfer portion is insufficient, and the effect of mitigating the impact when the sheet P enters the secondary transfer portion cannot be sufficiently obtained, and the shock jitter cannot be sufficiently reduced. As a result, the toner image that is primarily transferred at this time is disturbed, and the abnormal images due to the shock jitter may be generated.

As described above, when the margin amount on the leading end side of the sheet P is small, the restraint of the abnormal images due to insufficient transfer pressure on the leading end side image portion and the restraint of the abnormal images due to the shock jitter cannot be compatible. The abnormal images due to the shock jitter, described above, is a horizontal streak-like density unevenness of the image caused by the speed difference between the intermediate transfer belt 5 and the photoconductor 1. The speed difference is caused by the fluctuation of the surface moving speed of the intermediate transfer belt due to the shock generated when the leading end of the sheet P enters the secondary transfer portion.

The inventors found that the degree of the abnormal images caused due to the shock jitter, i.e., the degree of defects perceived by humans as abnormal image, is different depending on the image pattern of the abnormal image portion, for example, a line drawing image such as a text image, a halftone image, a high-density image (e.g., solid image), and so forth. That is, depending on the image pattern of the image portion in which the abnormal images are generated due to the shock jitter, there are cases where the image is easily perceived as an abnormal image, or where the image is difficult to perceive as an abnormal image.

In order to handle such a situation, in the present embodiment, it is determined whether the toner image formed in the opposing area on each one of the photoconductors 1Y, 1M, 1C, and 1K (the surface portion of the photoconductor existing in the primary transfer portion) facing the intermediate transfer belt 5 when the leading end of the paper P enters the secondary transfer portion is an image pattern with a low degree of perception of the abnormal images due to the shock jitter. Then, when it is determined that the condition for reducing the abnormal images is satisfied (when the abnormal images due to the shock jitter is difficult to be perceived), the nipping operation is controlled so as to prioritize restraint of the abnormal images due to insufficient transfer pressure of the leading end side image portion. For example, the nipping operation is controlled so that the completion time of the nipping operation is accelerated. Thus, even if the amount of the margin on the leading end side of the sheet P is small, the abnormal images due to insufficient image can be restrained, while restraining the occurrence of the abnormal images (such as white spots) due to insufficient transfer pressure.

The description above is for the shock jitter when the leading end of the paper P enters the secondary transfer portion, the same applies to the shock jitter when the rear end of the sheet P exits the secondary transfer portion.

That is, when the sheet P exits the secondary transfer portion, the secondary transfer roller 15 is kept in the nipping position until just before the rear end of the sheet P exits the secondary transfer portion, and the specified secondary transfer nip pressure is applied to the secondary transfer portion. Then, after the rear end of the toner image on the intermediate transfer belt 5 exits the secondary transfer section, the stepping motor 22 that drives the eccentric cams 19 of the contact-separation mechanism is controlled so that the secondary transfer roller 15 switches to the separating position before the rear end of the sheet P exits the secondary transfer portion. As a result, when the rear end of the sheet P exits the secondary transfer portion, the movement of the secondary transfer roller 15 to the separating position is completed, and the secondary transfer roller 15 and the intermediate transfer belt 5 can be separated from each other. As a result, he impact when the rear end of the sheet P exits the secondary transfer portion is mitigated than when the rear end of the sheet P exits the secondary transfer portion with the secondary transfer roller 15 in the nipping position and in contact with the intermediate transfer belt 5. Therefore, the shock jitter that disturbs the toner images of each color primarily transferred from each one of the photoconductors 1Y, 1M, 1C, and 1K to the intermediate transfer belt 5 due to this impact, is reduced, the occurrence of the abnormal images (such as horizontal streak-shaped image density unevenness) caused by the shock jitter are restrained.

However, when the margin amount on the rear end side of the sheet P is small, after the rear end of the toner image on the intermediate transfer belt 5 passed through the secondary transfer portion and before the separating operation is completed, the rear end of the sheet may exit the secondary transfer portion. In this case, since the movement of the secondary transfer roller 15 to the separating position is not completed, the secondary transfer nip pressure is still applied to the secondary transfer section, and the effect of mitigating the shock when the paper P exits the secondary transfer section is not sufficiently obtained. Therefore, the shock jitter cannot be sufficiently reduced. As a result, the toner image that is primarily transferred at this time is disturbed, and the abnormal images due to the shock jitter may be generated.

On the other hand, in order to restrain the abnormal images due to the shock jitter when the rear end of the sheet P passes through the secondary transfer portion, the separating operation can be controlled so that the separating operation is completed before the end of the sheet P exits the secondary transfer portion. However, in this case, the movement of the secondary transfer roller 15 to the separating position may be started before the rear end of the toner image on the intermediate transfer belt 5 passes through the secondary transfer portion. Therefore, the transfer pressure on the rear end side portion of the toner image on the intermediate transfer belt 5 is insufficient, and the image portion corresponding to the rear end side portion may be the abnormal images such as white spots.

As described above, even when the margin amount on the rear end side of the sheet P is small, the restraint of the abnormal images due to insufficient transfer pressure on the leading end side image portion and the restraint of the abnormal images due to the shock jitter cannot be compatible.

In order to avoid such situation, in the present embodiment, it is determined whether the toner image formed in the opposing area on each one of the photoconductors 1Y, 1M, 1C, and 1K (the surface portion of the photoconductor existing in the primary transfer portion) facing the intermediate transfer belt 5 when the rear end of the paper P exits the secondary transfer portion is an image pattern with a low degree of perception of the abnormal images due to the shock jitter. Then, when it is determined that the condition for reducing the abnormal images is satisfied (when the abnormal images due to the shock jitter is difficult to be perceived), the separating operation is controlled so as to prioritize restraint of the abnormal images due to insufficient transfer pressure of the rear end side image portion. For example, the separating operation is controlled so that the completion time of the separating operation is accelerated. Thus, even if the amount of the margin on the rear end side of the sheet P is small, the abnormal images due to the shock jitter can be restrained, while restraining the occurrence of the abnormal images (such as white spots) due to insufficient transfer pressure.

Figure 5:
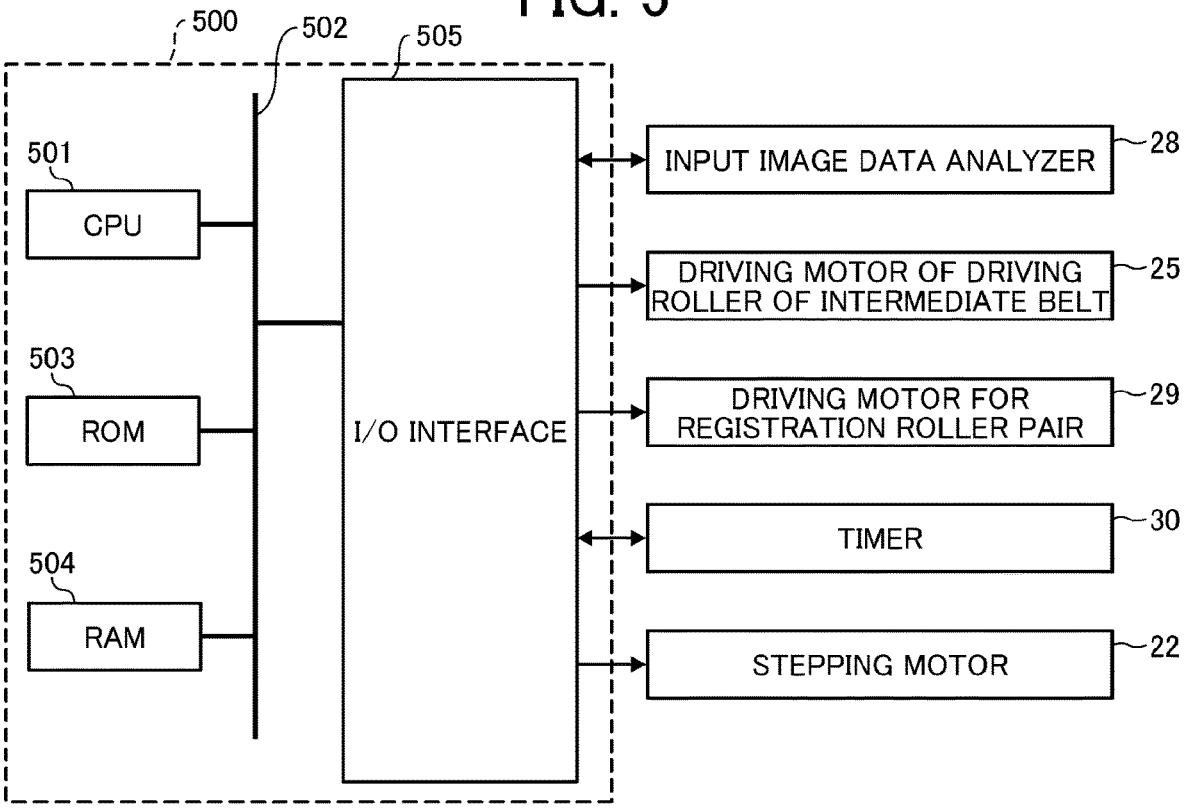
FIG. 5 is a block diagram illustrating an essential configuration of a control system in the image forming apparatus of FIG. 1.

FIG. 5 is a block diagram illustrating an example of the configuration of the control system of the image forming apparatus 100 according to the present embodiment. The image forming apparatus 100 includes a controller 500 (serving as control circuitry), which is configured with a computer such as a microcomputer. The controller 500 includes an input image data analyzer 28, a driving motor 25 for driving the driving roller 7 of the intermediate transfer belt 5, a driving motor 29 for a registration roller pair, a timer 30, a stepping motor 22, and so forth, via an I/O interface unit 505.

The controller 500 includes a CPU (Central Processing Unit) 501. Further, the controller 500 includes a ROM (Read Only Memory) 503 and a RAM (Random Access Memory) 504 as a storage member, which is connected to the CPU 501 via a bus line 502, and the I/O interface unit 505.

The CPU 501 executes various operations and drive control of each part by executing control programs which are computer programs incorporated in advance. The ROM 503 stores fixed data such as computer programs and data for control in advance. The RAM 504 functions as a work area, e.g., that rewritably stores various data. The controller 500 may be configured by using, for example, an IC or an LSI as a semiconductor circuit element manufactured for control in the image forming apparatus, instead of a computer device such as a microcomputer. Further, the controller 500 may have the function of the input image data analyzer 28.

The input image data analyzer 28 includes, for example, an image processor including a dedicated IC, LSI, and so forth. In the present embodiment, when the leading end of the sheet P enters the secondary transfer portion and when the rear end of the sheet P exits the secondary transfer portion (that is, when the shock jitter occurs), the information of the toner adhesion amount of the toner image portion formed in the opposing area on each one of the photoconductors 1Y, 1M, 1C, and 1K facing the intermediate transfer belt 5 is acquired. The amount of toner adhered to the toner image is effective information for discriminating image patterns having different degrees of perception of the abnormal images due to the shock jitter. Therefore, in the present embodiment, in order to determine whether or not the specified abnormal image reduction conditions are satisfied based on the information of the toner adhesion amount indicating the toner adhesion amount of this toner image portion, the information of the toner adhesion amount is obtained in the input image data analyzer 28.

In the present embodiment, the determination of whether or not the toner image portion satisfies the specified abnormal image reduction conditions is described based on the information of the toner adhesion amount of the toner image portion, the description based on other parameter information may be done.

Further, in the present embodiment, as the information of the toner adhesion amount of the toner image portion, the information of the image area ratio within the specified area including the photoconductors 1Y, 1M, 1C, and 1K which oppose the intermediate transfer belt 5 when the leading end of the sheet P enters the secondary transfer section (when the shock jitter occurs) is used. The information of the image area ratio is calculated in the input image data analyzer 28 from the respective image data of the toner image to be formed on each one of the photoconductors 1Y, 1M, 1C, and 1K based on the image data of the image to be printed.

The timer 30 is a time measuring member that determine the timing at which the leading end of the sheet P enters the secondary transfer portion. The timer 30 according to the present embodiment measures the time after driving motor 29 of the registration roller pair is turned on. Then, the timer 30 outputs a time-up signal to the controller 500 when the specified time required for the leading end of the sheet P to enter the secondary transfer portion after the driving motor 29 of the registration roller pair is turned on.

Figure 6:
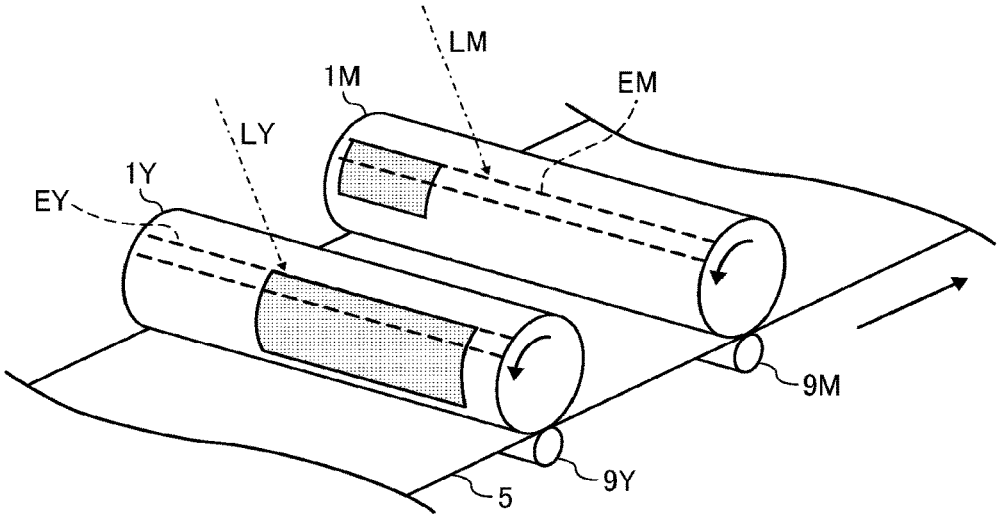
FIG. 6 is a diagram illustrating a method of calculating the image area ratio of a toner image portion formed on a yellow photoconductor and a magenta photoconductor based on image data in an input image data analyzer.
Figure 7A:
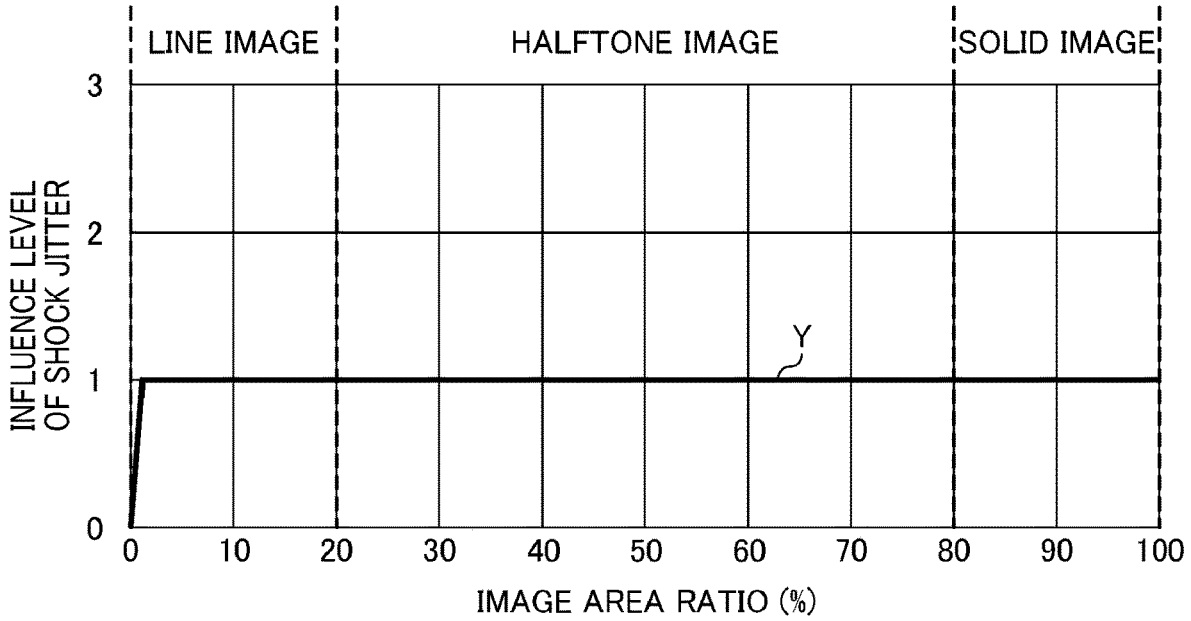
FIGS. 7A to 7D are graphs illustrating a relationship between the image area ratio in a specified area and influence level of shock jitter in each color toner image.
Figure 7B:
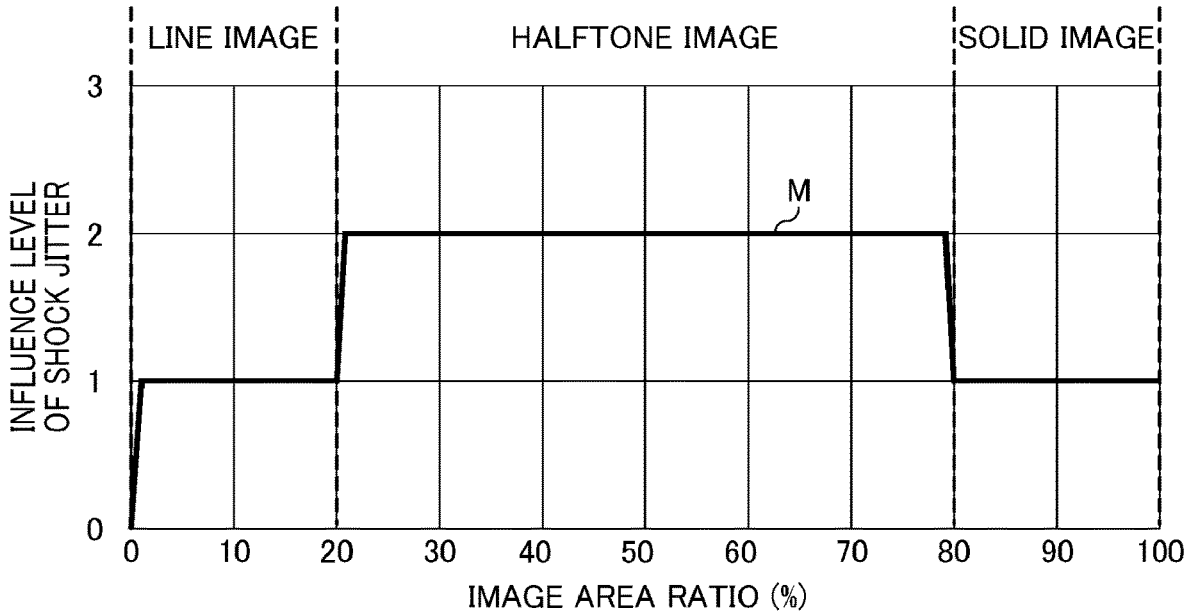
Figure 7C:
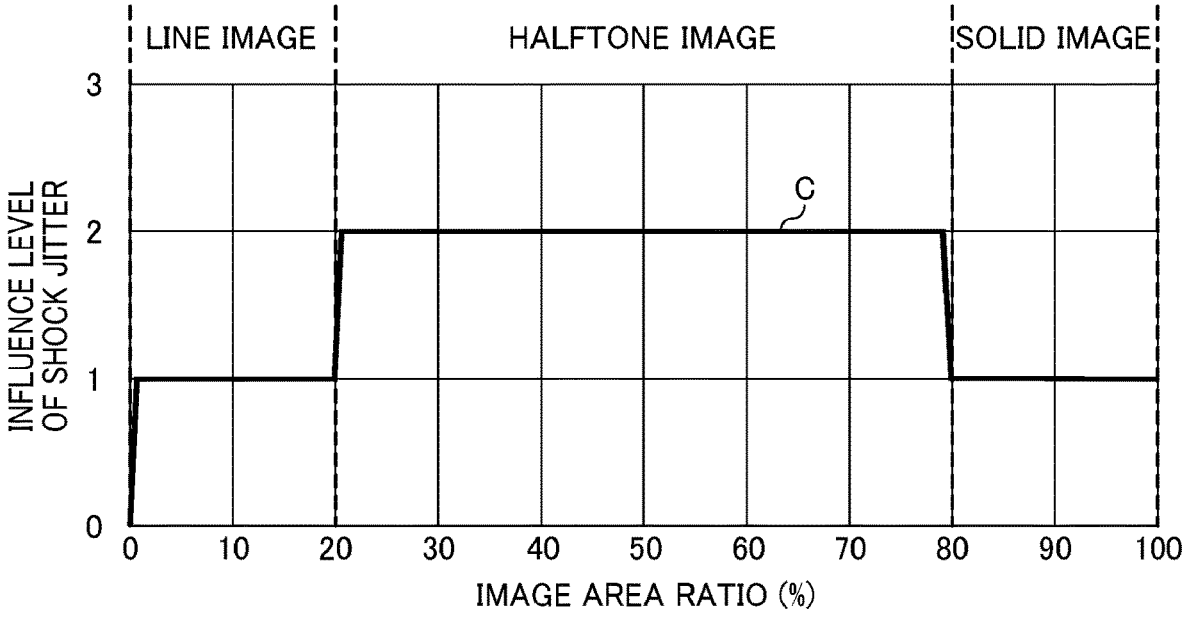
Figure 7D:
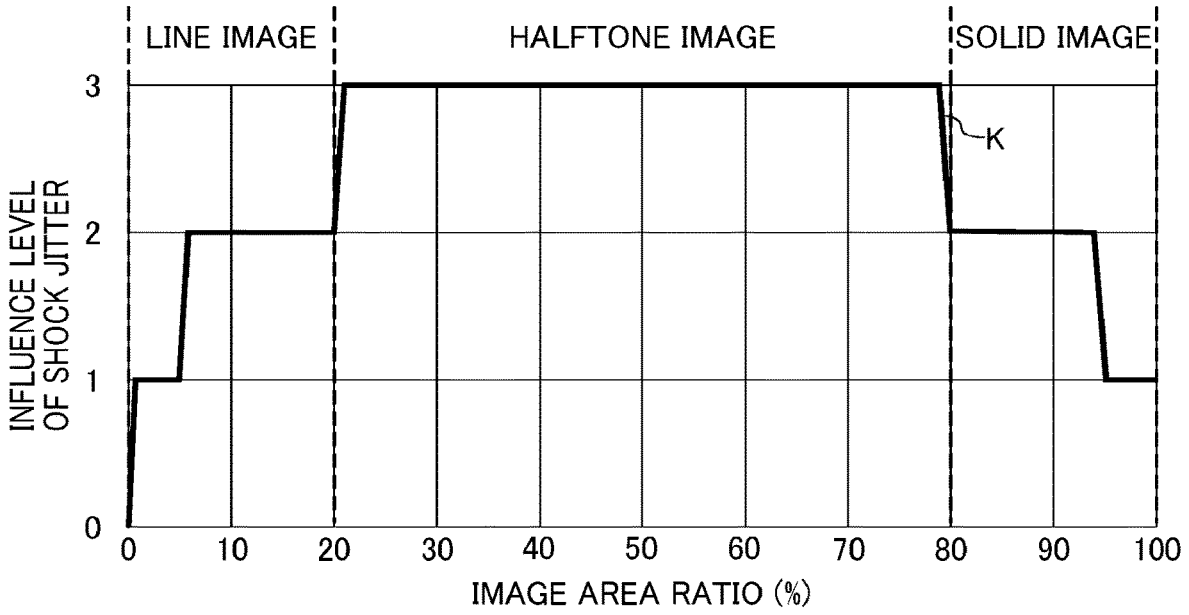

FIG. 6 is a diagram illustrating a method of calculating the image area ratio of the toner image portion formed on the yellow photoconductor 1Y and the magenta photoconductor 1M based on image data in the input image data analyzer 28. Although omitted in FIG. 6, the cyan photoconductor 1C and the black photoconductor 1K are similar.

The broken lines illustrated by the numerical symbols EY and EM in FIG. 6 indicate specified areas that obtain the image area ratio in the input image data analyzer 28. That is, the specified areas EY, EM, EC, and EK of each one of the photoconductors 1Y, 1M, 1C, and 1K are the areas including the facing areas (the surface portion of the photoconductors that presents in the primary transfer portion) on each photoconductor 1Y, 1M, 1C, and 1K that face the intermediate transfer belt 5 when the shock detector is generated (when the leading end of the sheet P enters the secondary transfer portion, or the rear end of the sheet P exits the secondary transfer portion).

The range of the toner image portion where the shock jitter may actually be generated is the nip width in the primary transfer portion (the length of the primary transfer nip in the movement direction of the intermediate transfer belt surface) in the movement direction of the photoconductor surface, and is narrower than the specified areas EY, EM, EC, and EK in the movement direction of the photoconductor surface. However, setting the specified areas EY, EM, EC, and EK to a range with a margin in the movement direction of the photoconductor surface is preferable, taking into consideration the control position error of the toner image portion and the time from the occurrence of the shock jitter until the effect of the shock jitter subsides in the primary transfer portion.

The impact that the secondary transfer roller 15 strikes the intermediate transfer belt 5 due to the nipping operation of the contact-separation mechanism, or the impact that the secondary transfer roller 15 separates from the intermediate transfer belt 5 due to the separating operation of the contact-separation mechanism, disturbs the toner image in the opposing area on the photoconductors 1Y, 1M, 1C, and 1K (the surface portion of the photoconductors existing in the primary transfer portion), may cause the abnormal images (horizontal streaks of uneven density) similar to the shock jitter. If the abnormal images caused by the shock jitter as well as the abnormal images caused by the impact when the secondary transfer roller 15 attaches to and detaches from the intermediate transfer belt 5 are taken into consideration, the specified areas EY, EM, EC, and EK may be set to the range that includes the toner image.

In the present embodiment, the specified areas EY, EM, EC, and EK, for example, the length in the moving direction of the photoconductor surface is 25 mm, and the length in the axis direction of the photoconductor is 330 mm. In the embodiment illustrated in FIG. 6, the image area ratio in the specified areas EY, EM, EC, and EK is, 50% for the yellow photoconductor 1Y, 30% for the magenta photoconductor 1M, 0% for the cyan photoconductor 1C, and 0% for the black photoconductor 1K.

FIGS. 7A to 7D are graphs illustrating a relationship between the image area ratio in a specified area EY, EM, EC, and EK, and the influence level of the shock jitter in each color toner image. As described above, the degree of the abnormal images due to the shock jitter, i.e., the degree of defect perceived by humans as the abnormal images differs depending on the image pattern of the abnormal image portion. Specifically, in the case of a line image such as a text image, even if the abnormal images due to the shock jitter occurs, humans may not easily perceive as the abnormal images. Also, in the case of a high-density image (solid image), humans may not easily perceive as the abnormal images when the abnormal images due to the shock jitter occur. On the other hand, for halftone images, with respect to a halftone image, when the abnormal images due to the shock jitter occur, humans may easily perceive as the abnormal image.

Since the perception degree of the abnormal images due to the shock jitter is different for each image pattern, and in the present embodiment, the perception degree of the abnormal images is divided into three stages as the influence level of the shock jitter. Specifically, as ill in FIGS. 7A to 7D, the case where the degree of perception of the abnormal images due to the shock jitter is the smallest is called as influence level 1 of the shock jitter, the case where the degree of perception of the abnormal images due to the shock jitter is medium is called as influence level 2 of the shock jitter, and the case where the degree of perception of the abnormal images due to the shock jitter is the largest is called as influence level 3 of the shock jitter.

Then, when the image area ratio is a first specified amount, for example, 20% or less, the image pattern of the specified areas EY, EM, EC, and EK is determined to be a line image such as a character image that humans are difficult to perceive as the abnormal images even if the abnormal images of the shock jitter are generated. In the present embodiment, when the image area ratio is another first specified amount, for example, 5% or less, the image pattern of the specified areas EY, EM, EC, and EK is determined to be a line image such as a character image that humans are further difficult to perceive as the abnormal images even if the abnormal images due to the shock jitter are generated.

In the present embodiment, when the image area ratio is a second specified amount, for example, 80% or more, the image pattern of the specified areas EY, EM, EC, and EK is determined to be a line image such as a high density image (solid image) that humans are difficult to perceive as the abnormal images even if the abnormal images due to the shock jitter are generated. Then, when the image area ratio is another second specified amount, for example, 95% or more, the image pattern of the specified areas EY, EM, EC, and EK is determined to be a line image such as a character image that humans are further difficult to perceive as the abnormal images even if the abnormal images due to the shock jitter are generated.

On the other hand, when the image area ratio is more than 20% and less than 80%, the image pattern of the specified areas EY, EM, EC, and EK is determined to be a halftone image that humans are easy to perceive as the abnormal images even if the abnormal images due to the shock jitter are generated.

Figure 8:
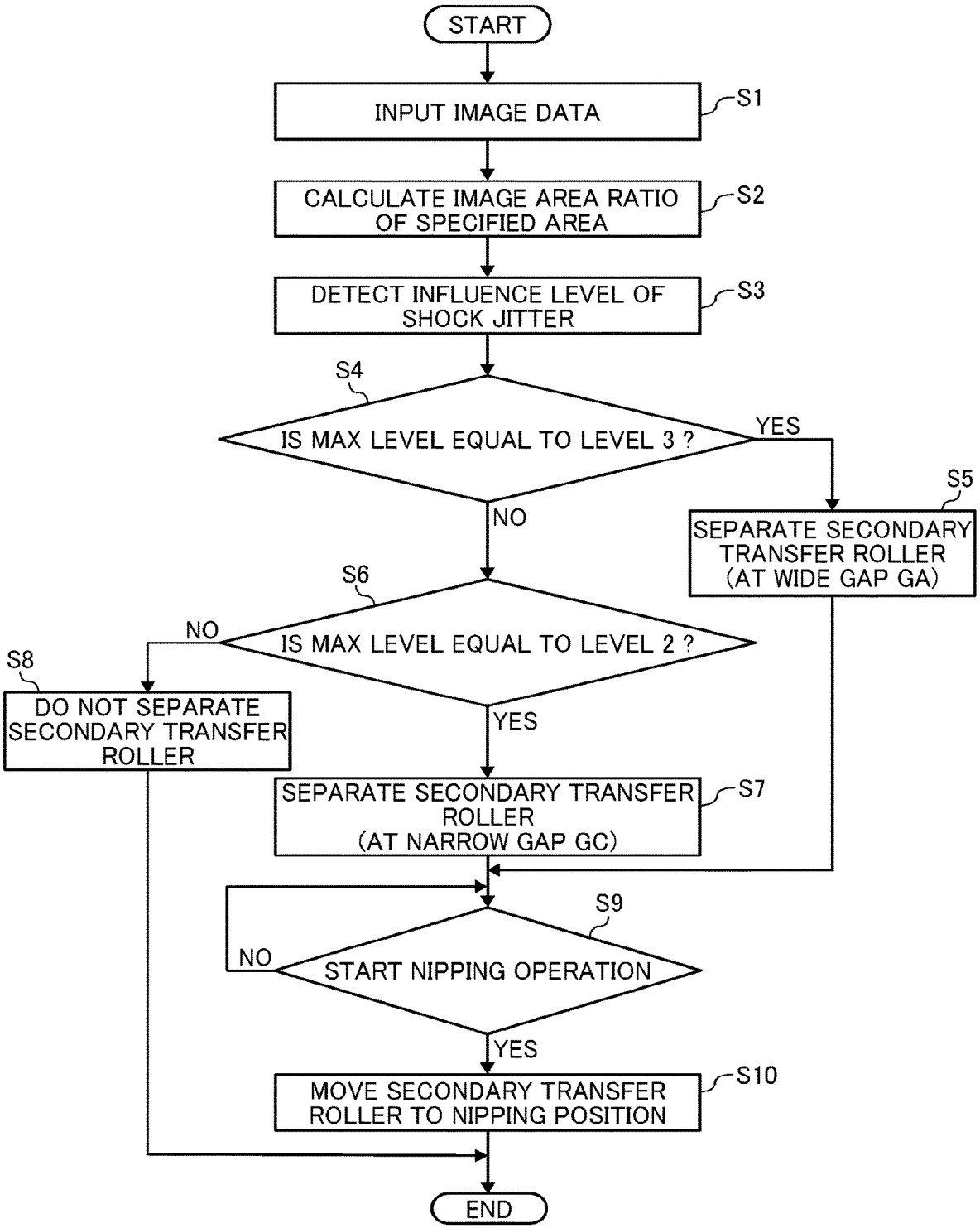
FIG. 8 is a flowchart illustrating a control flow during a nipping operation of the contact-separation mechanism according to the embodiment of this disclosure.

FIG. 8 is a flowchart illustrating a control flow during a nipping operation of the contact-separation mechanism according to the present embodiment. When the image data of the image to be printed is input (S1), the input image data analyzer 28 calculates the image area ratio in the specified areas EY, EM, EC, and EK including the facing areas on each one of the photoconductors 1Y, 1M, 1C, and 1K that face the intermediate transfer belt 5 at the timing when the leading end of the sheet P enters the secondary transfer portion based on the input image data (S2). The initial position of the secondary transfer roller 15 is set to the nipping position.

As illustrated in FIGS. 7A to 7D, even if the image pattern is the same (even if the image area ratio is the same), the degree of the abnormal images due to the shock jitter, i.e., the degree of defects perceived due to humans as the abnormal images is different depending on the color of the image. Specifically, in the case of the black (K) illustrated in FIG. 7D, the abnormal images due to the shock jitter are most easy for humans to perceive, and then, in the case of magenta (M) and cyan (C) illustrated in FIGS. 7B and 7C, the abnormal images due to the shock jitter are easy for humans to perceive, and in the case of yellow (Y) illustrated in FIG. 7A, the abnormal images due to the shock jitter are the most difficult for humans to perceive. Therefore, in the present embodiment, as illustrated in FIGS. 7A to 7D, the relationship between the image area ratio and the influence level of the shock jitter is set so as to differ for each color.

When the controller 500 receives the information of the image area ratio in each specified areas EY, EM, EC, and EK from the input image data analyzer 28, the controller 500 determines the influence level of the shock jitter of each color from the relationship between the image area ratio and the influence level of the shock jitter of each color illustrated in FIG. 6 (S3).

In the present embodiment, the case of the influence level 3 of the shock jitter, where the degree of perception of the abnormal images due to the shock jitter is the largest, is used as the reference, and the content of the nipping operation of the contact-separation mechanism that does not cause the abnormal images due to the shock jitter is controlled as the reference control. Therefore, the gap size (separation amount) when the nipping operation is performed is based on the wide gap size GA. Then, the content of the nipping operation is changed from the reference content based on the max level having the highest influence level of the shock jitter among the influence levels of the shock jitter of each color.

Specifically, when the max level is influence level 3 ("YES" in S4), the stepping motor 22 of the contact-separation mechanism is controlled to rotate the eccentric cams 19 so that the gap size is the reference wide gap size GA. As a result, the secondary transfer roller 15 takes the first separating position, and the secondary transfer roller 15 and the counter roller 18 are separated by the wide gap size GA (S5). When the leading end of the sheet P enters the secondary transfer portion where the secondary transfer roller 15 and the counter roller 18 are separated by the wide gap size GA, the nipping operation starts (S9), and the movement of the secondary transfer roller 15 to the nipping position is completed after the leading end of the sheet P enters the secondary transfer portion (S10). At this time, since the leading end of the sheet P enters the secondary transfer portion where the secondary transfer roller 15 and the counter roller 18 are separated by the wide gap size GA, the shock jitter is sufficiently alleviated. Accordingly, even if the abnormal images due to the shock jitter is the black halftone image (influence level of the shock jitter is level 3) that is most easily perceived, the abnormal images due to the shock jitter are restrained.

In this case, when the margin amount on the leading end side of the sheet P is small, the abnormal images such as white spots due to insufficient transfer pressure may occur on the image portion of the leading end side of the sheet P. A case where the amount of margin at the leading end side of sheet P is small enough to cause the abnormal images such as white spots due to insufficient transfer pressure is rare, in the present embodiment, the restraint of the abnormal images due to the shock jitter are prioritized.

On the other hand, when the max level is influence level 2 ("NO" in S4, and "YES" in S6), the stepping motor 22 of the contact-separation mechanism is controlled to rotate the eccentric cams 19 so that the gap size is changed from the wide gap size GA (reference) to the narrow gap size GC. As a result, the secondary transfer roller 15 takes the second separating position, and the secondary transfer roller 15 and the counter roller 18 are separated by the narrow gap size GC (S7). When the leading end of the sheet P enters the secondary transfer portion where the secondary transfer roller 15 and the counter roller 18 are separated by the narrow gap size GC, the nipping operation starts (S9), and the movement of the secondary transfer roller 15 to the nipping position is completed after the leading end of the sheet P enters the secondary transfer portion (S10). At this time, since the leading end of the sheet P enters the secondary transfer portion where the secondary transfer roller 15 and the counter roller 18 are separated by the narrow gap size GC, the mitigation effect of the shock jitter is slightly low. However, since the influence level of the shock jitter is level 2, which is the medium level of perceptibility of the abnormal images due to the shock jitter, the abnormal images due to the shock jitter can be sufficiently restrained.

Moreover, in this case, even when the margin amount on the leading end side of the sheet P is small, the gap size between the secondary transfer roller 15 and the counter roller 18 is narrow, so the movement to the position of the secondary transfer roller 15 can be completed before the leading edge of the toner image on the intermediate transfer belt 5 reaches the secondary transfer portion. Therefore, in the leading end side image portion of the sheet P, the occurrence of the abnormal images such as white spots due to insufficient transfer pressure can be restrained.

On the other hand, if the max level is influence level 1 ("No" in S4, and "No" in S6), the position of the secondary transfer roller 15 is kept at the position of the nipping position, and the secondary transfer roller 15 and the counter roller 18 are not separated (S8). In this case, since the leading end of the sheet P enters the secondary transfer portion in which the secondary transfer roller 15 and the intermediate transfer belt 5 are in contact with each other, the shock jitter occurs. However, since the influence level of the shock jitter is level 1 in which the perceptibility of the abnormal images due to the shock jitter is the lowest, even if the shock jitter occurs, the abnormal images due to the shock jitter are difficult to be perceived, and the abnormal images due to the shock jitter can be sufficiently restrained.

Moreover, in this case, even when the margin amount on the leading end side of the sheet P is small, an appropriate secondary transfer nip pressure can be certainly applied from the leading end of the toner image, and therefore, the occurrence of the abnormal images such as white spots due to insufficient transfer pressure can be restrained in the image area on the leading end side of the sheet P.

In the example illustrated in FIG. 6, the influence level of the shock jitter of each color is level 1 for yellow, level 2 for magenta, and level 0 (without toner) for cyan and black, and the influence level 2 of the shock jitter for magenta is adopted as max level. Therefore, the gap size is changed from the reference wide gap size GA to the narrow gap size GC, and the restraint of the abnormal images due to the shock jitter and the restraint of the abnormal images due to insufficient transfer pressure on the leading end side image portion of the sheet P can be compatible.

In the present embodiment, although the example of changing the separating position of the secondary transfer roller 15 is described as a method of changing the content of the nipping operation, not limited to the example, e.g., a method of changing the start timing of the nipping operation of the secondary transfer roller 15 can be similarly adopted. Specifically, for example, the gap size is fixed to the wide gap size GA, and when the max level is influence level 3, the nipping operation start timing is set to the latest timing (reference timing). When the max level is influence level 2, the nipping operation start timing is set earlier than the reference timing. When the max level is influence level 1, the nipping operation start timing is set further earlier than the reference timing.

Figure 9:
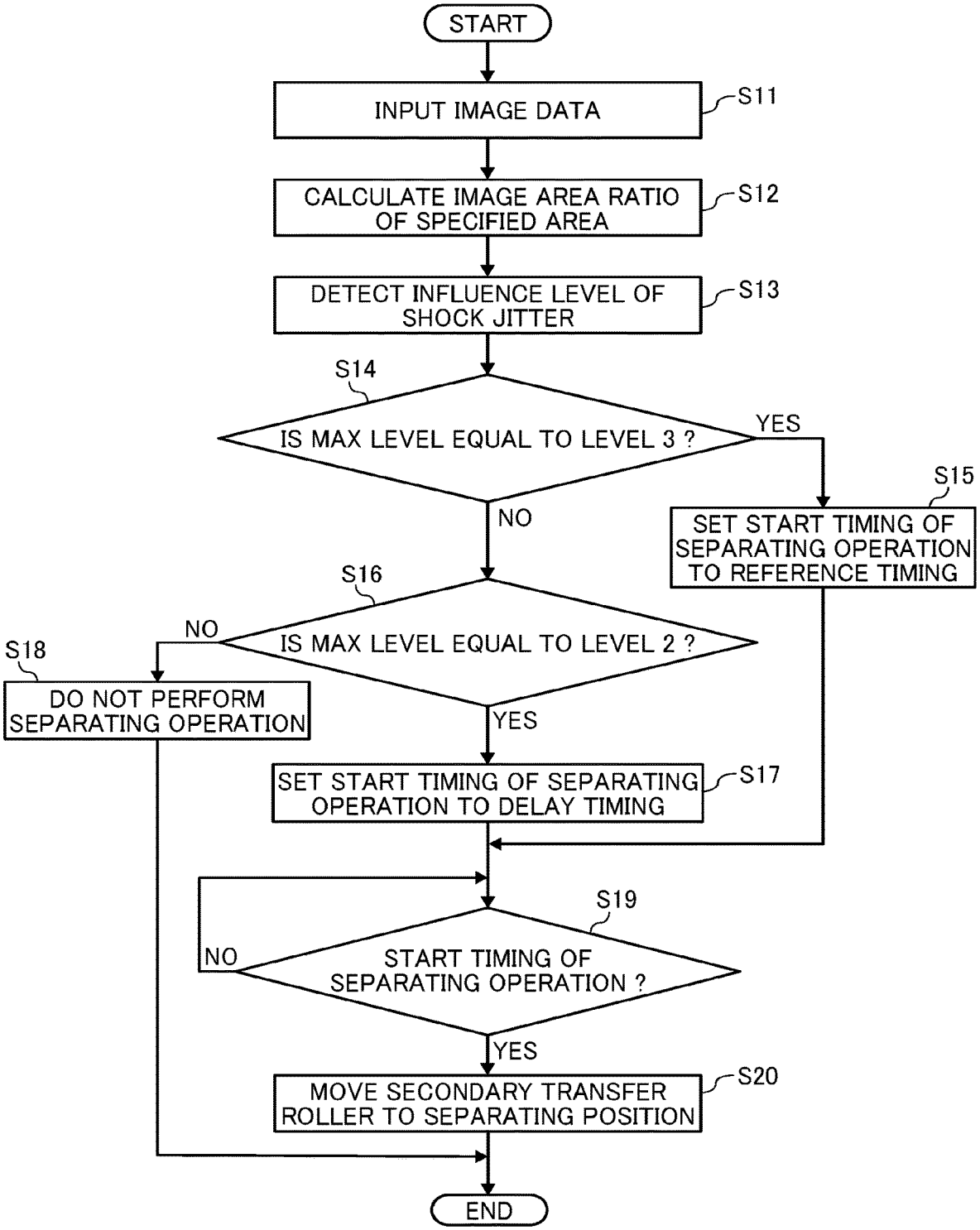
FIG. 9 is a flowchart illustrating a control flow during a separating operation of the contact-separation mechanism according to the embodiment of this disclosure.

FIG. 9 is a flowchart of the control processes during the separating operation of the contact-separation mechanism according to the present embodiment. When the image data of the image to be printed is input (S11), the input image data analyzer 28 calculates the image area ratio in the specified areas EY, EM, EC, and EK including the facing areas on each one of the photoconductors 1Y, 1M, 1C, and 1K that face the intermediate transfer belt 5 at the timing when the rear end of the sheet P exits the secondary transfer portion based on the input image data (S12). When the controller 500 receives the information of the image area ratio in each specified areas EY, EM, EC, and EK from the input image data analyzer 28, the controller 500 determines the influence level of the shock jitter of each color from the relationship between the image area ratio and the influence level of the shock jitter (S13) of each color illustrated in FIG. 6.

In the present embodiment, the case of the influence level 3 of the shock jitter, where the degree of perception of the abnormal images due to the shock jitter is the largest, is used as the reference, and the content of the separating operation of the contact-separation mechanism that does not cause the abnormal images due to the shock jitter is controlled as the reference control. Therefore, the start timing for performing the separating operation is based on a relatively early timing so that the movement of the secondary transfer roller 15 to the separating position is completed until the rear end of the sheet P passes through the secondary transfer portion. Then, the content of the separating operation is changed from the reference content based on the max level having the highest influence level of the shock jitter among the influence levels of the shock jitter of each color.

Specifically, when the max level is influence level 3 ("YES" in S14), the controller 500 sets the start timing of the separating operation to be the reference timing. When the set separating operation start timing arrives (S19), the separating operation starts, and the movement of the secondary transfer roller 15 to the separating position is completed before the rear end of the sheet P exits the secondary transfer portion (S20). As a result, the shock jitter is mitigated, and even if the abnormal images due to the shock jitter is the black halftone image (the influence level of the shock jitter is level 3) that is most easily perceived, the abnormal images due to the shock jitter are restrained.

In this case, when the margin amount on the rear end side of the sheet P is small, the abnormal images such as white spots due to insufficient transfer pressure may occur on the image portion of the rear end side of the sheet P. A case where the amount of margin at the rear end side of sheet P is small enough to cause the abnormal images such as white spots due to insufficient transfer pressure is rare, in the present embodiment, the restraint of the abnormal images due to the shock jitter is prioritized.

On the other hand, when the max level is the influence level 2 ("NO" in S14, and "YES" in S16), the start timing of the separating operation is changed from the reference timing to the delay timing slower than the reference timing (S17). When the set separating operation start timing arrives (S19), the separating operation starts, and the movement of the secondary transfer roller 15 to the separating position is completed before the rear end of the sheet P exits the secondary transfer portion (S20). At this time, since the start timing of the separating operation is delayed, the rear end of the paper P may exit the secondary transfer portion before the secondary transfer roller 15 completely moves to the separating position, and the shock jitter mitigation effect is slightly lower. However, since the influence level of the shock jitter is level 2, which is the medium level of perceptibility of the abnormal images due to the shock jitter, the abnormal images due to the shock jitter can be sufficiently restrained.

Moreover, even when the rear end side of the sheet P is small, since the separating operation of the secondary transfer roller 15 start timing is slow, the separating operation of the secondary transfer roller 15 can be started after the rear end of the toner image on the intermediate transfer belt 5 exits from the secondary transfer portion. Therefore, in the rear end side image portion of the sheet P, the occurrence of the abnormal images such as white spots due to insufficient transfer pressure can be restrained.

On the other hand, in the case where the max level is influence level 1 ("NO" in S14, and "NO" in S16), the position of the secondary transfer roller 15 is kept at the position of the nipping position, and the secondary transfer roller 15 and the counter roller 18 are not separated (S8). In this case, since the rear end of the sheet P exits the secondary transfer portion in which the secondary transfer roller 15 and the intermediate transfer belt 5 are in contact with each other, the shock jitter occurs. However, since the influence level of the shock jitter is level 1 in which the perceptibility of the abnormal images due to the shock jitter is the lowest, even if the shock jitter occurs, the abnormal images due to the shock jitter are difficult to be perceived, and the abnormal images due to the shock jitter can be sufficiently restrained.

Moreover, in this case, even when the margin amount on the rear end side of the sheet P is small, an appropriate secondary transfer nip pressure can be certainly applied to the rear end of the toner image, and therefore, the occurrence of the abnormal images such as white spots due to insufficient transfer pressure can be restrained in the image area on the rear end of the sheet P.

In the present embodiment, although the configuration in which the secondary transfer roller 15 is attached to and detached from the intermediate transfer belt 5 is described, at least one of the secondary transfer roller 15 and the intermediate transfer belt 5 may be attached to and detached from the other.

Further, in the present embodiment, the controller 500 determines whether or not the toner image portion formed in the opposing area on each one of the photoconductors 1Y, 1M, 1C, and 1K facing the intermediate transfer belt 5 when the shock jitter occurs satisfies the specified reduction condition of the abnormal images based on the information of the toner adhesion amount of the toner image portion, but is not limited thereto. In particular, in the present embodiment, although the information of the image area ratio is used as the information of the toner adhesion amount, other information of the toner adhesion amount may be used such as detection information detected by a sensor that detects the amount of toner adhesion on the photoconductor 1.

Further, in the present embodiment, although the nipping operation and the separating operation are changed in consideration of the color of the toner image portion that is primarily transferred when the shock jitter occurs, the color does not need to be considered. On the other hand, although not considered in the present embodiment, the distance between the primary transfer portion of each photoconductor which generates the abnormal images due to the shock jitter and the secondary transfer section in which the shock jitter (the distance along the movement direction of the intermediate transfer belt surface) is generated may be considered. The shorter this distance is in the primary transfer portion, the greater the influence of the shock jitter generated in the secondary transfer portion, and the greater the degree of the abnormal images due to the shock jitter.

Note that it is easy for a person skilled in the art to modify or amend the present invention within the scope of the claims to form another embodiment, and these modifications or amendments are included in the scope of the claims. The description above is only an example of the present disclosure, and does not limit the scope of the claims.

The above-described embodiments are given as an example, and, for example, the following aspects of the present disclosure may have advantageous effects described below.

First Aspect

According to a first aspect, an image forming apparatus (e.g., the image forming apparatus 100) includes latent image bearers (e.g., the photoconductors 1Y, 1M, 1C, and 1K), a toner image forming unit (e.g., the charger 2, the optical writing device 3, and the developing device 4), primary transfer members (e.g., the primary transfer rollers 9K, 9C, 9M, and 9Y), a secondary transfer member (e.g., the secondary transfer roller 15), a switching unit (e.g., contact-separation mechanism), and a controller (e.g., the controller 500 and the input image data analyzer 28). The toner image forming unit forms toner images on the latent image bearer. The primary transfer members primarily transfer toner images borne on the latent image bearer onto an intermediate transfer member (e.g., intermediate transfer belt 5). The secondary transfer member sandwiches a recording material (e.g., sheet P) conveyed, at a secondary transfer portion between the secondary transfer member and the intermediate transfer member, and secondarily transfer the toner images borne on the intermediate transfer member onto the recording material (e.g., sheet P). The switching unit switches a position of one of the secondary transfer member and the intermediate transfer member between a first position (e.g., nipping position) at which the secondary transfer member and the intermediate transfer member sandwiches the recording material and a second position (e.g., separating position) at which a distance between the intermediate transfer member and the secondary transfer member is farther than at the first position (e.g., nipping position). The controller controls at least one of a first operation (e.g., nipping operation) in which the second position (e.g., separating position) is switched to the first position (e.g., nipping position) and a second operation (e.g., separating operation) in which the first position (e.g., nipping position) is switched to the second position (e.g., separating position). The controller changes at least one of the first operation (e.g., nipping position) and the second operation (e.g., separating operation) when a toner image portion formed in an opposing area on the latent image bearer opposing the intermediate transfer member satisfies a specified abnormal image reduction condition at a first timing at which a leading end of the recording material (e.g., sheet P) enters the secondary transfer portion and a second timing at which a trailing end of the recording material (e.g., sheet P) exits the secondary transfer portion. The impact generated at the timing when the recording material (e.g., sheet P) enters the secondary transfer portion and the impact generated at the timing when the recording material (e.g., sheet P) exits the secondary transfer portion cause the shock jitter that disturbs the toner image portion that is being primarily transferred from the latent image bearer to the intermediate transfer member. Therefore, the toner image portion primarily transferred at this timing (when the shock jitter occurs) is secondarily transferred onto the recording material (e.g., sheet P), and the abnormal images are generated. In order to restrain the occurrence of the abnormal images due to the shock jitter, in the first aspect, the first operation (e.g., nipping operation) is performed to switch the position of the secondary transfer member from the second position (e.g., separating position) to the first position (e.g., nipping position) at the timing when the recording material (e.g., sheet P) enters the secondary transfer portion, and the second operation (e.g., separating operation) is performed to switch the position of the secondary transfer member from the first position (e.g., nipping position) to the second position (e.g., separating position) at the timing when the recording material exits the secondary transfer portion. By performing the first operation (e.g., nipping operation), the impact when the recording material (e.g., sheet P) enters the secondary transfer portion is mitigated and the shock jitter can be restrained, compared to the case where the recording material (e.g., sheet P) enters the secondary transfer portion when the secondary transfer member is in the first position (e.g., nipping position). By performing the second operation (e.g., separating operation), the impact when the recording material (e.g., sheet P) exits the secondary transfer portion is mitigated and the shock jitter can be restrained, compared to the case where the recording material (e.g., sheet P) exits the secondary transfer portion while the secondary transfer member is in the first position (e.g., nipping position). However, when the margin amount on the leading end side of the recording material (e.g., sheet P) is small, the leading end side image portion enters the secondary transfer portion after the leading end of the recording material (e.g., sheet P) enters the secondary transfer portion and before the first operation (e.g., nipping operation) is completed. In this case, since the secondary transfer member is not reached the nipping position, the transfer pressure on the leading end side image portion existing in the secondary transfer portion (between the secondary transfer member and the intermediate transfer member) is insufficient, and the abnormal images occur in the leading end side image portion. On the other hand, if the first operation (e.g., nipping operation) is controlled so that the first operation (e.g., nipping operation) is completed before the leading end side image portion reaches the secondary transfer portion in order to restrain the abnormal images of the leading end image portion, when the leading end of the recording material (e.g., sheet P) enters the secondary transfer portion, the amount of separation between the secondary transfer member and the intermediate transfer member is insufficient, and the shock jitter cannot be reduced. As a result, the toner image portion that is primarily transferred is disturbed at this time, and the abnormal images occur in the image portion corresponding to the toner image portion. Therefore, the restraint of the abnormal images due to insufficient transfer pressure on the leading end side image portion and the restraint of the abnormal images due to the shock jitter cannot be compatible. Even in the case of the second operation (e.g., separating operation) as well, for the same reason, when the margin amount on the rear end side of the recording material (e.g., sheet P) is small, the restraint of the abnormal images due to insufficient transfer pressure of the rear end side image portion and the restraint of the abnormal images due to the shock jitter cannot be compatible. The inventors found that the degree of the abnormal images due to the shock jitter, i.e., the degree of defect perceived by humans as abnormal image, is different depending on the image pattern of the abnormal image portion, for example, a line drawing image such as a text image, a halftone image, a high-density image (e.g., solid image), and so forth. That is, depending on the image pattern of the image portion in which the abnormal images are generated due to the shock jitter, there are cases where the image is easily perceived as an abnormal image, or where the image is difficult to perceive as an abnormal image. In the first aspect, the content of the first operation (e.g., nipping operation) and the second operation (e.g., separating operation) are changed when the toner image portion formed on the facing area on the latent image bearer facing the intermediate transfer member satisfies the specified abnormal image reduction condition for determining that the image pattern has a low degree of perception of the abnormal images due to the shock jitter at the timing when the recording material (e.g., sheet P) enters the secondary transfer portion or when the recording material (e.g., sheet P) exits the secondary transfer portion. According to the first aspect, when the toner image portion primarily transferred at the timing (when the shock jitter occurs) is the image pattern that is difficult for humans to perceive as the abnormal image, even if the shock jitter is large, the first operation (e.g., nipping operation) can be controlled so as to prioritize the restraint of the abnormal images due to insufficient transfer pressure of the leading end side image portion and the rear end side image portion. As a result, when the margin amount on the leading end side of the recording material (e.g., sheet P) is small or when the margin amount on the rear end side of the recording material (e.g., sheet P) is small, the number of cases of compatibility of the restraint of the abnormal images due to insufficient transfer pressure and the restraint of the abnormal images due to the shock jitter can be increased.

Second Aspect

According to a second aspect, in the first aspect, the controller determines whether the abnormal image reduction condition is satisfied according to information of a toner adhesion amount (e.g., information of the image area ratio) of the toner image portion. The inventors found that the amount of toner adhered to the toner image portion is effective information for discriminating image pattern having a difference in the degree of perception of the abnormal images due to the shock jitter. Therefore, according to the second aspect, the degree of perception of the abnormal images due to the shock jitter can be properly determined.

Third Aspect

According to a third aspect, in the second aspect, the controller uses, as the information of the toner adhesion amount, information of an image area ratio in a specified area including the opposing area on the latent image bearer. According to the third aspect, the information of the toner adhesion amount in the form of the image area ratio, which is effective for discriminating image pattern having a difference in the degree of perception of the abnormal images due to the shock jitter can be easily acquired.

Fourth Aspect

According to a fourth aspect, in the third aspect, the controller calculates the information of the image area ratio from image data of the toner image formed on the latent image bearer. According to the fourth aspect, the information of the image area ratio can be easily acquired.

Fifth Aspect

According to a fifth aspect, in any one of the first aspect to the fourth aspect, the controller sets the position of the one of the secondary transfer member and the intermediate transfer member to the first position before the first timing or the second timing, when the toner image portion satisfies the abnormal image reduction condition. According to the fifth aspect, when the margin amount on the leading end side of the recording material (e.g., sheet P) is small or when the margin amount on the rear end side of the recording material (e.g., sheet P) is small, the number of cases of compatibility of the restraint of the abnormal images due to insufficient transfer pressure and the restraint of the abnormal images due to the shock jitter can be increased.

Sixth Aspect

According to a sixth aspect, in any one of the first aspect to the fifth aspect, the switching unit further sets the position of the one of the secondary transfer member and the intermediate transfer member to a third position that is between the first position (e.g., nipping position) and the second position (e.g., separating position), the controller sets the position of the one of the secondary transfer member and the intermediate transfer member to the third position before the first timing, when the toner image portion satisfies the abnormal image reduction condition. According to the sixth aspect, in the case where the toner image portion primarily transferred when the shock jitter occurs is the image pattern that is difficult for humans to perceive as abnormal image, the movement from the second position (e.g., separating position) to the first position (e.g., nipping position) is completed earlier during the first operation (e.g., nipping operation). Therefore, even when the amount of the leading end side of the recording material (e.g., sheet P) is small, the abnormal images due to insufficient transfer pressure of the leading end side image portion can be restrained.

Seventh Aspect

According to a seventh aspect, in the sixth aspect, the abnormal image reduction condition includes a condition that information of a toner adhesion amount of the toner image portion indicates a toner adhesion amount of a specified amount or less. According to the seventh aspect, line drawing images such as character images that is difficult to be perceived by humans as the abnormal images can be properly discriminated when the abnormal images due to the shock jitter occur.

Eighth Aspect

According to an eighth aspect, in the sixth aspect or the seventh aspect, the abnormal image reduction condition includes a condition that information of a toner adhesion amount of the toner image portion indicates a toner adhesion amount of a specified amount or more. According to the eighth aspect, high-density images such as solid images that is difficult to be perceived by humans as the abnormal images can be properly discriminated when the abnormal images due to the shock jitter occur.

Ninth Aspect

According to a ninth aspect, in any one of the first aspect to the eighth aspect, the image forming apparatus includes a plurality of latent image bearers, a plurality of toner image forming units, and controller. The plurality of latent image bearers are arranged along a movement direction of a surface of the intermediate transfer member so as to face the intermediate transfer member. The plurality of toner image forming units form toner images of different colors (e.g., yellow (Y), magenta (M), cyan (C), and black (K)) on each latent image bearer. The controller change the at least one of the first operation (e.g., nipping operation) and the second operation (e.g., nipping operation), based on whether the toner image portion of a selected color selected according to a specified selection condition satisfies the abnormal image reduction condition. Even if the image pattern is the same, the degree of the abnormal images due to the shock jitter, i.e., the degree of defects perceived by humans as the abnormal images is different depending on the color of the image. According to a ninth aspect, since whether or not the abnormal image reduction condition is satisfied in consideration of the color can be determined, the restraint of the abnormal images due to the shock jitter and the restraint of the abnormal images due to insufficient transfer pressure can be properly compatible.

Tenth Aspect

According to a tenth aspect, in the ninth aspect, the controller controls the at least one of the first operation (e.g., nipping operation) and the second operation (e.g., separating operation) so that the second position (e.g., separating position) in the first operation (e.g., nipping operation) is farther from the intermediate transfer member when the selected color is black than when the selected color is a reference color (e.g., magenta or cyan) or so that a start timing of the first operation (e.g., nipping operation) is later or a start timing of the second operation (e.g., separating operation) is earlier when the selected color is black than when the selected color is the reference color (e.g., magenta or cyan).

Eleventh Aspect

According to a eleventh aspect, in the ninth aspect or the tenth aspect, the controller controls the at least one of the first operation (e.g., nipping operation) and the second operation (e.g., separating operation) so that the second position (e.g., separating position) of the first operation (e.g., nipping operation) is closer to the intermediate transfer member when the selected color is yellow than when the selected color is a reference color (e.g., magenta or cyan) or so that a start timing of the first operation (e.g., nipping operation) is earlier or a start timing of the second operation (e.g., separating operation) is later when the selected color is yellow than when the selected color is the reference color (e.g., magenta or cyan). According to the tenth aspect, when the abnormal images due to the shock jitter occur, even in the case of yellow images that are easily perceived as the abnormal images by humans, the restraint of the abnormal images due to the shock jitter and the restraint of the abnormal images due to insufficient transfer pressure can be properly compatible.

Twelfth Aspect

According to a twelfth aspect, in any one of the ninth aspect to the eleventh aspect, the controller controls the at least one of the first operation (e.g., nipping operation) and the second operation (e.g., separating operation) so that as a distance along the movement direction of the surface of the intermediate transfer member between the secondary transfer portion and one of the plurality of latent image bearers on which a toner image of the selected color is formed is shorter, the second position (e.g., separating position) of the first operation (e.g., nipping operation) is farther from the intermediate transfer member, a starting timing of the first operation (e.g., nipping operation) is later, or a start timing of the second operation (e.g., separating operation) is earlier. Even if the image pattern is the same, the shorter the distance between the latent image bearer and the secondary transfer portion along the intermediate transfer member surface movement direction, the greater the influence of the shock jitter generated in the secondary transfer portion. According to a twelfth aspect, since whether or not the abnormal image reduction condition is satisfied in consideration of the distance can be determined, the restraint of the abnormal images due to the shock jitter and the restraint of the abnormal images due to insufficient transfer pressure can be properly compatible.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. An image forming apparatus comprising:

a latent image bearer;

a toner image forming unit configured to form a toner image on the latent image bearer;

an intermediate transfer member;

a primary transfer member configured to primarily transfer the toner image borne on the latent image bearer onto the intermediate transfer member;

a secondary transfer member configured to:

sandwich a recording material conveyed, at a secondary transfer portion between the secondary transfer member and the intermediate transfer member; and secondarily transfer the toner image borne on the intermediate transfer member onto the recording material;

a switching unit configured to switch a position of one of the secondary transfer member and the intermediate transfer member between a first position at which the secondary transfer member and the intermediate transfer member sandwiches the recording material and a second position at which a distance between the intermediate transfer member and the secondary transfer member is farther than at the first position; and control circuitry configured to control at least one of a first operation in which the second position is switched to the first position and a second operation in which the first position is switched to the second position, wherein the control circuitry is configured to change at least one of the first operation and the second operation when a toner image portion formed in an opposing area on the latent image bearer opposing the intermediate transfer member satisfies a specified abnormal image reduction condition at a first timing at which a leading end of the recording material enters the secondary transfer portion and a second timing at which a trailing end of the recording material exits the secondary transfer portion.

2. The image forming apparatus according to claim 1, wherein the control circuitry is configured to determine whether the abnormal image reduction condition is satisfied according to information of a toner adhesion amount of the toner image portion.

3. The image forming apparatus according to claim 2, wherein the control circuitry is configured to use, as the information of the toner adhesion amount, information of an image area ratio in a specified area including the opposing area on the latent image bearer.

4. The image forming apparatus according to claim 3, wherein the control circuitry is configured to calculate the information of the image area ratio from image data of the toner image formed on the latent image bearer.

5. The image forming apparatus according to claim 1, wherein the control circuitry is configured to set the position of the one of the secondary transfer member and the intermediate transfer member to the first position before the first timing or the second timing, when the toner image portion satisfies the abnormal image reduction condition.

6. The image forming apparatus according to claim 1, wherein the switching unit is further configured to set the position of the one of the secondary transfer member and the intermediate transfer member to a third position that is between the first position and the second position, and wherein the control circuitry is configured to set the position of the one of the secondary transfer member and the intermediate transfer member to the third position before the first timing, when the toner image portion satisfies the abnormal image reduction condition.

7. The image forming apparatus according to claim 1, wherein the abnormal image reduction condition includes a condition that information of a toner adhesion amount of the toner image portion indicates a toner adhesion amount of a specified amount or less.

8. The image forming apparatus according to claim 1, wherein the abnormal image reduction condition includes a condition that information of a toner adhesion amount of the toner image portion indicates a toner adhesion amount of a specified amount or more.

9. The image forming apparatus according to claim 1, further comprising:

a plurality of latent image bearers including the latent image bearer and being arranged along a movement direction of a surface of the intermediate transfer member so as to face the intermediate transfer member; and a plurality of toner image forming units including the toner image forming unit and being configured to form toner images of different colors on the plurality of latent image bearers, wherein the control circuitry is configured to change the at least one of the first operation and the second operation, based on whether the toner image portion of a selected color selected according to a specified selection condition satisfies the abnormal image reduction condition.

10. The image forming apparatus according to claim 9, wherein the control circuitry is configured to control the at least one of the first operation and the second operation so that the second position in the first operation is farther from the intermediate transfer member when the selected color is black than when the selected color is a reference color or so that a start timing of the first operation is later or a start timing of the second operation is earlier when the selected color is black than when the selected color is the reference color.

11. The image forming apparatus according to claim 9, wherein the control circuitry is configured to control the at least one of the first operation and the second operation so that the second position of the first operation is closer to the intermediate transfer member when the selected color is yellow than when the selected color is a reference color or so that a start timing of the first operation is earlier or a start timing of the second operation is later when the selected color is yellow than when the selected color is the reference color.

12. The image forming apparatus according to claim 9, wherein the control circuitry is configured to control the at least one of the first operation and the second operation so that as a distance along the movement direction of the surface of the intermediate transfer member between the secondary transfer portion and one of the plurality of latent image bearers on which a toner image of the selected color is formed is shorter, the second position of the first operation is farther from the intermediate transfer member, a starting timing of the first operation is later, or a start timing of the second operation is earlier.

* * * * *